US005172168A

United States Patent [19]

Satoh et al.

[11] Patent Number: 5,172,168

[45] Date of Patent: Dec. 15, 1992

[54] ELECTROPHOTOGRAPHIC SYSTEM HAIVNG A DEVELOPING DEVICE WITH A PLURALITY OF TONER FEEDERS

[75] Inventors: Norihide Satoh, Chikushino; Yuzo Kawano, Oonojo, both of Japan

[73] Assignee: Matsushita Electric Industrial Co., Ltd., Osaka, Japan

[21] Appl. No.: 754,808

[22] Filed: Sep. 5, 1991

[30] Foreign Application Priority Data

| | | | |
|---|---|---|---|
| Sep. 5, 1990 | [JP] | Japan | 2-236766 |
| Sep. 26, 1990 | [JP] | Japan | 2-258004 |
| Sep. 26, 1990 | [JP] | Japan | 2-258005 |
| Sep. 26, 1990 | [JP] | Japan | 2-258008 |
| Oct. 1, 1990 | [JP] | Japan | 2-264024 |
| Oct. 1, 1990 | [JP] | Japan | 2-264025 |

[51] Int. Cl.[5] ..... G03G 15/08

[52] U.S. Cl. ..... 355/245; 118/653; 118/656; 355/251

[58] Field of Search ..... 355/245, 260, 251, 253, 355/259, 261; 118/653, 651, 656, 657, 658, 661; 222/DIG. 1

[56] References Cited

U.S. PATENT DOCUMENTS

| | | | |
|---|---|---|---|
| 4,864,349 | 9/1989 | Ito | 118/653 X |
| 4,937,625 | 6/1990 | Kato et al. | 355/245 |
| 4,941,019 | 7/1990 | Honda et al. | 355/245 X |
| 4,956,673 | 9/1990 | Abuyama et al. | 355/245 |
| 4,987,452 | 1/1991 | Nagagawa et al. | 355/245 |
| 4,993,829 | 2/1991 | Naganuma et al. | 355/245 X |

FOREIGN PATENT DOCUMENTS

| | | | |
|---|---|---|---|
| 0249172 | 12/1985 | Japan | 355/260 |
| 144375 | 6/1988 | Japan . | |

*Primary Examiner*—A. T. Grimley
*Assistant Examiner*—Robert Beatty
*Attorney, Agent, or Firm*—Lowe, Price, LeBlanc & Becker

[57] ABSTRACT

An electrophotographic system for use as a laser beam printer, a copying machine, or the like has an image carrier for receiving an electrostatic latent image, a developing device for developing the electrostatic latent image into a toner image with toner, and a toner hopper for storing into a toner, and a toner hopper for storing the toner. A plurality of toner feeders is disposed in the toner hopper, for supplying the toner from the toner hopper to the developing device. The toner feeders being successively arranged with respect to the developing device such that those toner feeders which are disposed more remotely from the developing device feed progressively smaller amounts of toner. The toner feeders are rotatable to feed the toner to the developing device, and the toner feeders which are disposed more remotely from the developing device rotate at progressively lower speeds or have progressively smaller areas of contact with the toner. Since the amounts of toner fed by the toner feeders are progressively smaller the more remotely disposed from the developing device they are, the amount of toner supplied to a toner feeder is smaller than the amount of toner fed by the toner feeder, which prevents the toner from being aggregated in the toner hopper.

5 Claims, 16 Drawing Sheets

ELECTROPHOTOGRAPHIC SYSTEM HAIVNG A DEVELOPING DEVICE WITH A PLURALITY OF TONER FEEDERS

BACKGROUND OF THE INVENTION

1. Field of the Invention

The present invention relates to an electrophotographic system for visualizing an electrostatic latent image on an image carrier with toner particles, transferring the visualized toner image onto a sheet of paper, and fixing the toner image to the sheet with heat or pressure.

2. Description of the Prior Art

Electrophotographic systems now in use mostly employ dry toner as a developer, and are used as copying machines, laser beam printers, or the like. In addition to monochromatic electrophotographic copying machines, there have recently been developed color copying machines based on the electrophotographic principles to meet demands for colored copies in the market.

In the electrophotographic systems, an electrostatic latent image on a photosensitive body with a photosensitive layer is developed into a visual image with toner particles by a developing unit. The developing unit generally has a toner hopper for supplying toner. As the toner is gradually consumed by the developed unit, the amount of toner held by the toner hopper is reduced. Some toner particles tend to stick to the inner wall surface of the toner hopper, producing solidified masses or blocks of toner, or to be deposited in trapping spaces. When toner remains in the toner hopper, the storage capacity of the toner hopper is reduced. Various attempts have heretofore been made to prevent toner from being formed into blocks and reduce the toner particles kept in the trapping spaces, so that the toner contained in the toner hopper can fully be supplied to the developing unit and the storage capacity of the toner hopper can effectively be utilized.

One conventional electrophotographic system as a copying machine is shown in FIG. 15 of the accompanying drawings. The electrophotographic system has an image carrier 1 comprising a belt of synthetic resin such as polyethylene terephthalate coated on its outer surface with a thin photosensitive layer of selenium (Se) or organic photoconductor (OPC). The image carrier 1 is trained around two vertically spaced feed rollers 2, 3 so that the image carrier 1 has a vertically flat surface. The feed rollers 2, 3 are driven to rotate by a drive motor (not shown) to move the image carrier 1 in a circulating manner in the direction indicated by the arrow A. The electrophotographic system also has a developing unit 6 for developing an electrostatic latent image on the image carrier 1 into a visible image with toner particles, the developing unit 6 being disposed closely to the flat surface of the image carrier 1.

The developing unit 6 has a toner hopper 15 for storing a supply of toner 14, a developing roller 84, a doctor blade 30 for limiting the height of toner fibers attached to the developing roller 84, and a plurality of toner feeders 83*a*, 83*b*, 83*c* in the form of wires of the same diameter bent into a rectangular shape and having opposite ends rotatably supported on opposite sides of the toner hopper 15. The toner feeders 83*a*, 83*b*, 83*c* serve to prevent the toner 14 from being formed into blocks or masses, and feed the toner 14 to the developing roller 30.

The conventional electrophotographic system shown in FIG. 15 operates as follows:

In the developing unit 6, the toner feeders 83*a*, 83*b*, 83*c* in the toner hopper 15 rotate in synchronism with the developing roller 84, along circular paths indicated by the dot-and-dash lines at the same speed, for stirring the toner 14 and feeding the toner 14 to the developing roller 84.

When a potential difference is applied between the developing roller 84 and the image carrier 1, the toner 14 fed onto the developing roller 84 is attracted to an electrostatic latent image on the image carrier 1, developing the electrostatic latent image into a visible toner image. As the electrostatic latent image is developed with the toner 14, the toner 14 is consumed by the image development, and the toner 14 in the toner hopper 15 is additionally fed to the developing roller 84 by the toner feeders 83*a*, 83*b*, 83*c*.

As described above, the toner feeders (wires) 83*a*, 83*b*, 83*c* are of the same diameter and rotate at the same speed. Therefore, when the amount of toner 14 supplied to the developing roller 84 by the toner feeder 83*a* is greater than the amount of toner 14 attracted to the electrostatic latent image on the image carrier 1 by the developing roller 84, since the toner feeders 83*b*, 83*c* supply the toner feeder 83*a* with an amount of toner commensurate with the amount of toner that has been supplied to the developing roller 84 by the toner feeder 83*a*, the toner on the developing roller 84 tends to be aggregated as the toner is consumed by the developing unit 6.

SUMMARY OF THE INVENTION

It is an object of the present invention to provide an electrophotographic system which prevents toner from being aggregated on an image carrier.

According to the present invention, there is provided an electrophotographic system comprising an image carrier for forming an electrostatic latent image represented by image information, developing means for developing the electrostatic latent image into a toner image with toner, a toner hopper for storing the toner, and a plurality of toner feeders disposed in the toner hopper, for supplying the toner from the toner hopper to the developing means, the toner feeders being successively arranged with respect to the developing means such that those toner feeders which are disposed more remotely from the developing means feed progressively smaller amounts of toner.

The toner feeders are rotatable to feed the toner to the developing housing, and the toner feeders which are disposed more remotely from the developing housing rotate at progressively lower speeds or have progressively smaller areas of contact with the toner. Since the amounts of toner fed by the toner feeders are progressively smaller more remotely from the developing housing, the amount of toner supplied to a toner feeder is smaller than the amount of toner fed thereby, thereby preventing the toner from being aggregated in the toner hopper.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

Identical parts are noted by identical reference characters throughout views.

DETAILED DESCRIPTION OF THE PREFERRED EMBODIMENTS

Figure 1:
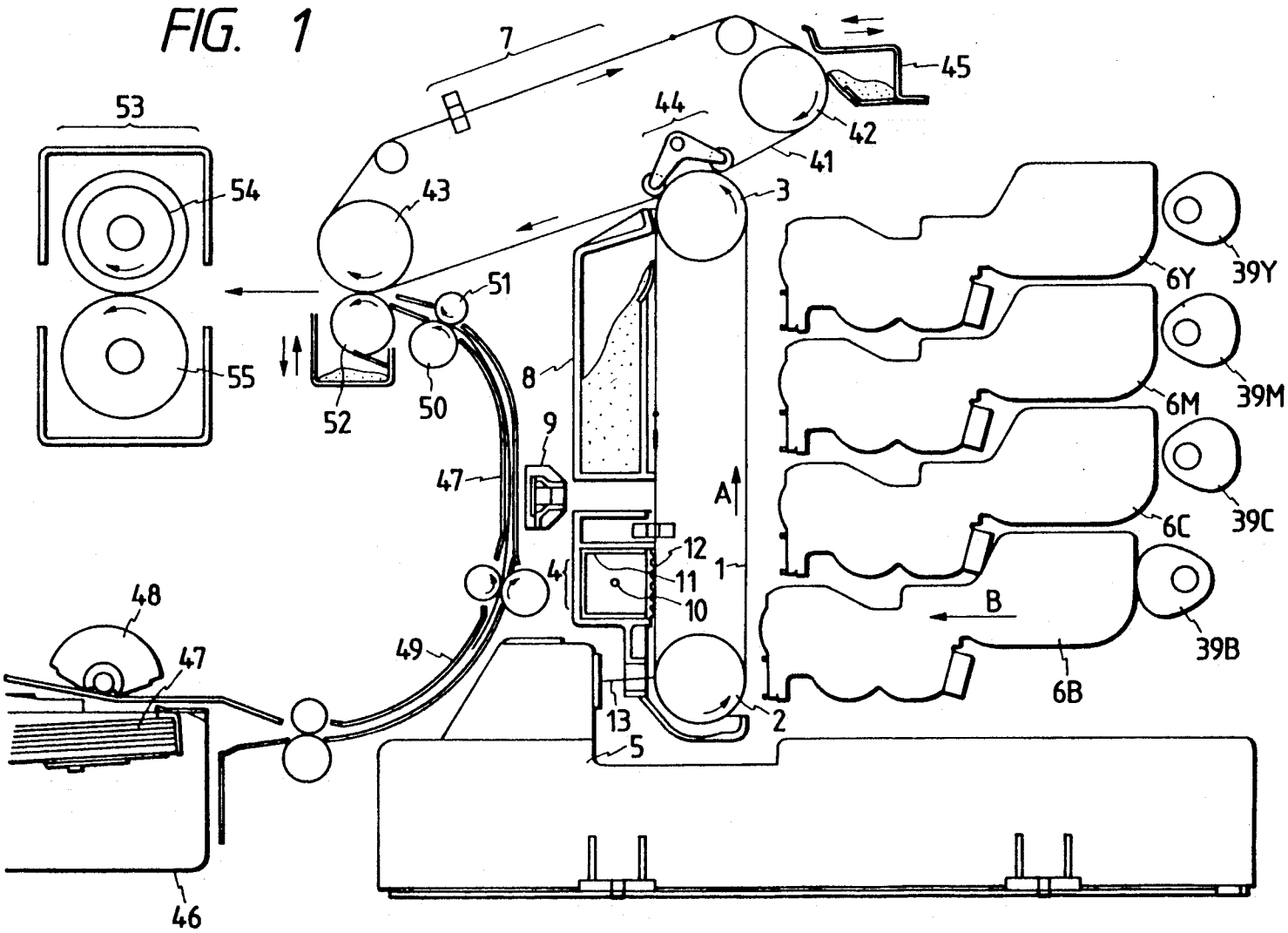
FIG. 1 is a schematic side elevational view of an electrophotographic system according to an embodiment of the present invention.
Figure 2:
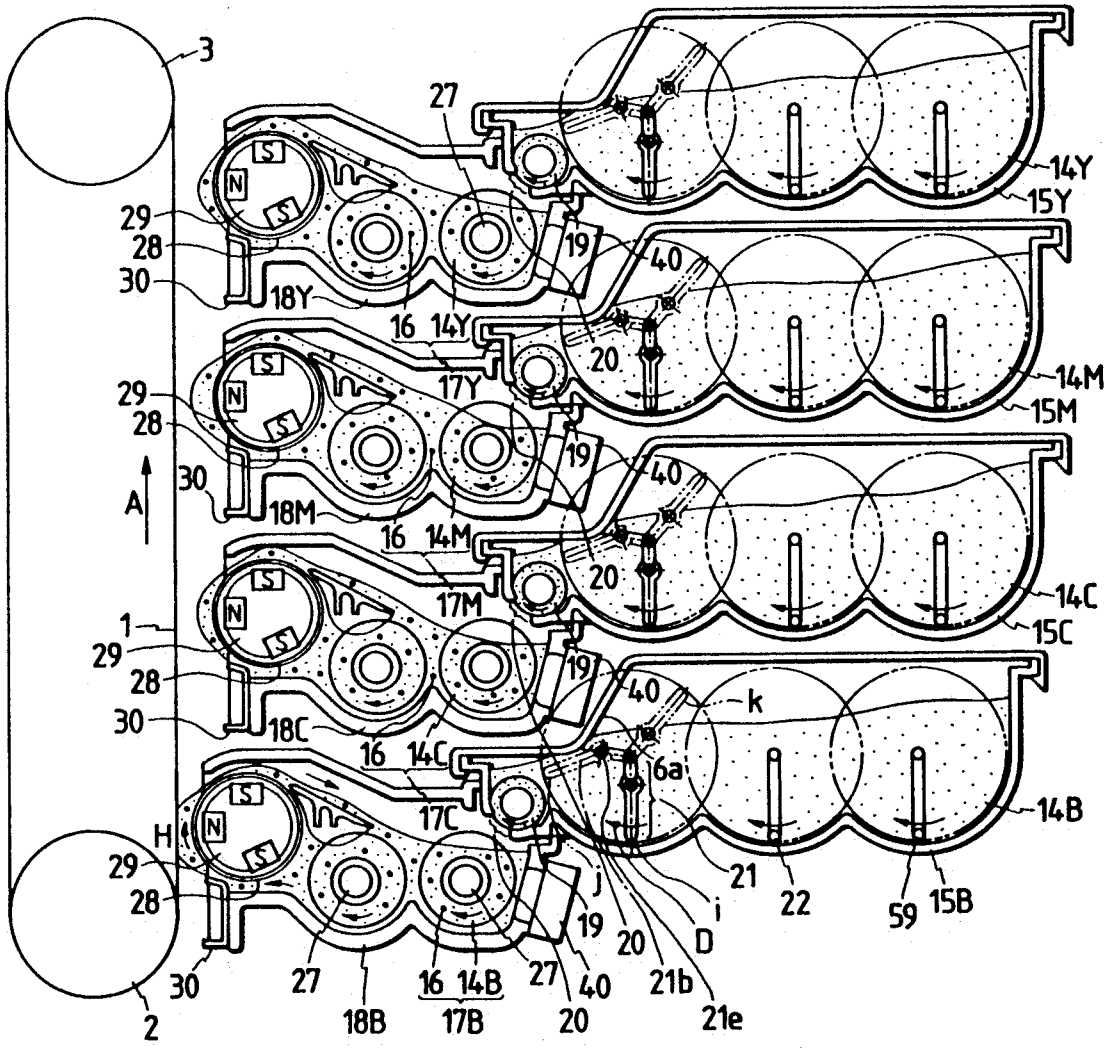
FIG. 2 is an enlarged side elevational view of a developing unit assembly in the electrophotographic system shown in FIG. 1.

FIGS. 1 and 2 show an electrophotographic system according to a first embodiment of the present invention. In the illustrated embodiment, the electrophotographic system comprises a color electrophotographic system such as a color laser beam printer, for example. The electrophotographic system has an image carrier 1 comprising a belt of synthetic resin such as polyethylene terephthalate coated on its outer surface with a thin photosensitive layer of selenium (Se), organic photoconductor (OPC), or the like. The image carrier 1 is trained around two vertically spaced feed rollers 2, 3 so that the image carrier 1 has a vertically flat surface. The feed rollers 2, 3 are driven to rotate by a drive motor (not shown) to move the image carrier 1 in a circulating manner in the direction indicated by the arrow A.

The electrophotographic system also has a charger 4, an exposure optical system 5, a stacked assembly of developing units 6B, 6C, 6M, 6Y for developing images of black (B), cyan (C), magenta (M), and yellow (Y), respectively, an intermediate image transfer unit 7, an image carrier cleaner 8, and a charge eraser 9. These components are successively arranged around the image carrier 1 in the direction indicated by the arrow A.

The charger 4 comprises a charging wire 10 such as a tungsten wire, a shield casing 11 of metal housing the charging wire 10, and a grid plate 12 supported on the shield casing 11 and positioned between the charging wire 10 and the image carrier 1. When a high voltage is applied to the charging wire 10 by a high voltage source, the charging wire 10 causes a corona discharge that uniformly charges the image carrier 1 through the grid plate 12.

The exposure optical system 5 emits a light beam 13 representative of image information to be recorded. If the electrophotographic system is in the form of a laser beam printer, then the exposure optical system 5 is controlled by a signal from a host computer (not shown) to apply laser beams to form electrostatic latent images corresponding to respective colors on the image carrier 1.

Figure 5:
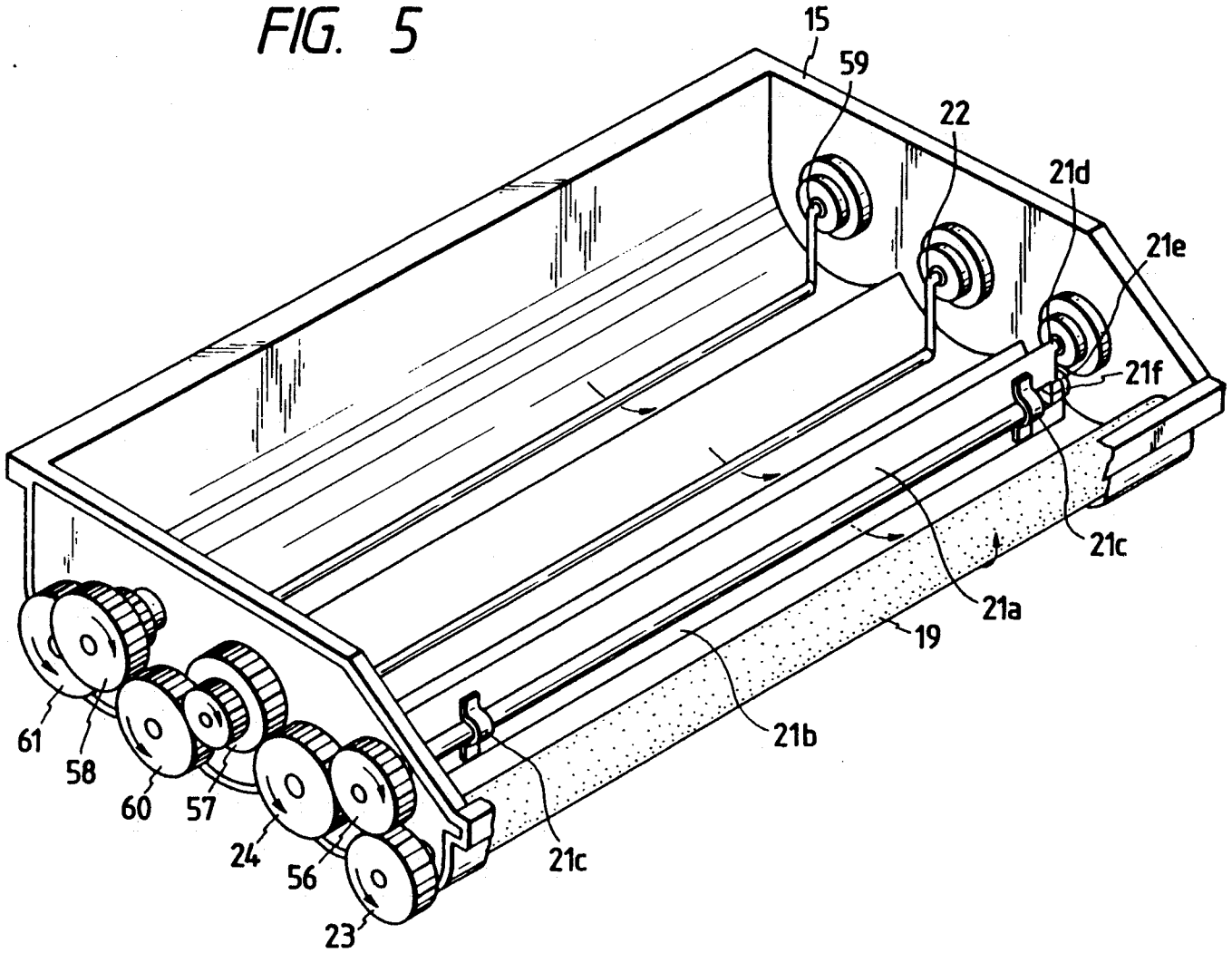
FIG. 5 is a perspective view of a driving mechanism for each developing unit in the electrophotographic system shown in FIG. 1.

The developing units 6B, 6C, 6M, 6Y generally comprise respective toner hoppers 15B, 15C, 15M, 15Y for storing toners 14B, 14C, 14M, 14Y corresponding to the respective colors, and respective developing housings 18B, 18C, 18M, 18Y for storing developers 17B, 17C, 17M, 17Y, respectively, that are a mixture of the toners 14B, 14C, 14M, 14Y and a carrier 16 in the form of magnetic particles such as iron powder particles. The developing units 6B, 6C, 6M, 6Y are successively arranged upwardly in the order named in a vertical stack along the vertically flat surface of the image carrier 1. The developing units 6B, 6C, 6M, 6Y include respective toner discharge rollers 19 for supplying the toners 14B, 14C, 14M, 14Y from the toner hoppers 15B, 15C, 15M, 15Y into the developing housings 18B, 18C, 18M, 18Y, the toner discharge rollers 19 being made of highly resilient plastic foam. The toner discharge rollers 19 are rotatably supported on opposite side walls of the toner hoppers 15B, 15C, 15M, 15Y, and substantially close toner discharge ports 20 thereof. The developing units 6B, 6C, 6M, 6Y have first toner feeders 21 each comprises, as shown in FIG. 5, a toner feeder member 21*a*, a toner feeder member 21*b*, and return springs 21*c*. The first toner feeders 21 are rotatably supported on opposite side walls of the toner hoppers 15B, 15C, 15M, 15Y by shafts 21*d* on opposite ends of the toner feeder members 21*a*. The toner feeder members 21*a* also have shafts 21*e* on their opposite ends that are supported by respective bearings 21*f* on opposite ends of the toner feeder members 21*b*, so that the toner feeder members 21*b* are rotatably supported on the toner feeder members 21*a* by the shafts 21*e*. In each of the developing units 6B, 6C, 6M, 6Y, the return springs 21*c* interconnect the toner feeder members 21*a*, 21*b* to each other, and keep the toner feeder member 21*b* that is angularly movable about the shafts 21*e* in a certain angular position with respect to the toner feeder member 21*a*.

The developing units 6B, 6C, 6M, 6Y also include respective second toner feeders 22 and respective third toner feeders 59. The second and third toner feeders 22, 59 are in the form of a wire bent into a rectangular shape, and are rotatably supported on the opposite side walls of the toner hoppers 15B, 15C, 15M, 15Y in the same manner as the first toner feeders 21. The first, second, and third toner feeders 21, 22, 59 serve to prevent the toners 14B, 14C, 14M, 14Y from being formed into solidified blocks or masses in the respective toner hoppers 15B, 15C, 15M, 15Y, and also to feed the toners 14B, 14C, 14M, 14Y into toner discharge ports 20. The first toner feeders 21 are composed of two major components, i.e., the first and second toner feeder members 21*a*, 21*b*, that are angularly movable with respect to each other. Such a structure is effective in increasing the storage capacity of the toner hoppers 15B, 15C, 15M, 15Y without increasing the height of the developing units 6B, 6C, 6M, 6Y, and is particularly useful in color electrophotographic systems that employ a vertical stack of developing units.

The developing housings 18B, 18C, 18M, 18Y house therein respective pairs of stirring rollers 27 rotatably supported on opposite side walls of the developing housings 18B, 18C, 18M, 18Y. The stirring rollers 27 mix and stir the toners 14B, 14C, 14M, 14Y supplied from the toner hoppers 15B, 15C, 15M, 15Y through the toner discharge ports 20, with the carrier 16*k*, thereby charging the toners 14B, 14C, 14M, 14Y, and also feed the mixture to developing rollers 28 that are rotatably supported in the developing housings 18B, 18C, 18M, 18Y, respectively. The toners 14B, 14C, 14M, 14Y and the carrier 16 that are fed to the developing rollers 28 are magnetically attracted to outer circumferential surfaces of the developing rollers 28 by magnet rollers 29 fixedly mounted in the developing rollers 28. The toners 14B, 14C, 14M, 14Y and the carrier 16 that are magnetically attracted to the developing rollers 28 form magnetic brushes whose toner fibers are limited in height by doctor blades 30 attached to the developing housings 18B, 18C, 18M, 18Y beneath the developing rollers 28. When the developing rollers 28 rotate, the magnetic brushes of the developers 17B, 17C, 17M, 17Y are selectively held in contact with the image carrier 1, forming toner images composed of the toners 14B, 14C, 14M, 14Y of the respective colors attracted to the electrostatic latent images on the image carrier 1. The toners 14B, 14C, 14M, 14Y are selectively supplied to the image carrier 1 by rotating displacing cams 39B, 39C, 39M, 39Y (see FIG. 1), respectively, which are rotatably supported on opposite side walls of an electrophotographic system housing (not shown) in response to a color selection signal from the host computer, thereby to displacing a selected developing unit, e.g., 6B, into contact with the image carrier 1. The remaining developing units 6C, 6M, 6M, for example, that are not selected are spaced from the image carrier 1 under the bias of springs (not shown).

The mixture ratios of the toners 14B, 14C, 14M, 14Y and the carrier 16 in the developing housings 18B, 18C, 18M, 18Y are detected by respective toner concentration detectors 40 (FIG. 2) mounted respectively on the developing housings 18B, 18C, 18M, 18Y.

As shown in FIG. 1, the intermediate image transfer unit 7 comprises an intermediate image transfer belt 41 of electrically conductive synthetic resin, two feed rollers 42, 43 around which the intermediate image transfer belt 41 is trained, and intermediate image transfer rollers 44 belt against the image carrier 1 with the intermediate image transfer belt 41 interposed therebetween, for transferring toner images from the image carrier 1 to the intermediate image transfer belt 41. The length of the outer circumferential surface of the intermediate image transfer belt 41 is equal to the length of the outer circumferential surface of the image transfer belt 41 can be scraped off by a cleaner 45. While a composite image is being formed on the intermediate image transfer belt 41 by toner images transferred from the image carrier 1, the cleaner 45 is spaced from the intermediate image transfer belt 41. The cleaner 45 is held in contact with the intermediate image transfer belt 41 only when it cleans the intermediate image transfer belt 41.

Copy sheets 47 are stored in a copy sheet cassette 46, and can be supplied, one at a time, to a sheet path 49 by a semicircular sheet feed roller 48. A copy sheet 47 supplied to the sheet path 49 is temporarily stopped by a resist roller 50 so that the copy sheet 47 can be held in registration with a composite image on the intermediate image transfer belt 41. The resist roller 50 is held in pressing contact with a follower roller 51, and stops the copy sheet 47 when the copy sheet 47 is supplied thereto and positioned between the resist roller 50 and the follower roller 51. The composite image on the intermediate image transfer belt 41 can be transferred therefrom to the copy sheet 47 by an image transfer roller 52 that is held against the feed roller 43 with the intermediate image transfer belt 41 interposed therebetween. When the composite image is to be transferred from the intermediate image transfer belt 41, the image transfer roller 52 is brought into contact with the intermediate image transfer belt 41 so that the copy sheet 47 can be sandwiched under pressure between the image transfer roller 52 and the intermediate image transfer belt 41.

An image fixing unit 53 is positioned downstream of the image transfer roller 52. The image fixing unit 53 comprises a heater roller 54 that houses a heater (not shown) therein and a presser roller 55 held against the heater roller 54. When the copy sheet 47 with the composite image transferred thereto is supplied to the image fixing unit 53, the composite image is fixed to the copy sheet 47 with heat and pressure by the heater roller 54 and the presser roller 55 as they sandwich the copy sheet 47 while rotating.

Figure 3A:
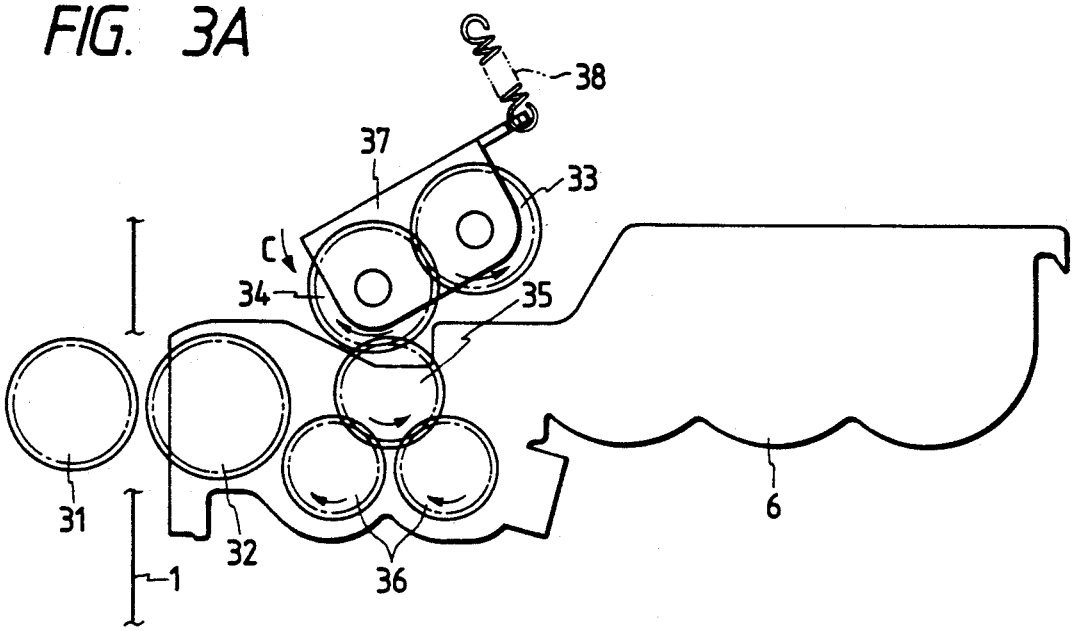
FIGS. 3A and 3B are schematic views showing the manner in which a developing unit is displaced toward an image carrier.
Figure 3B:
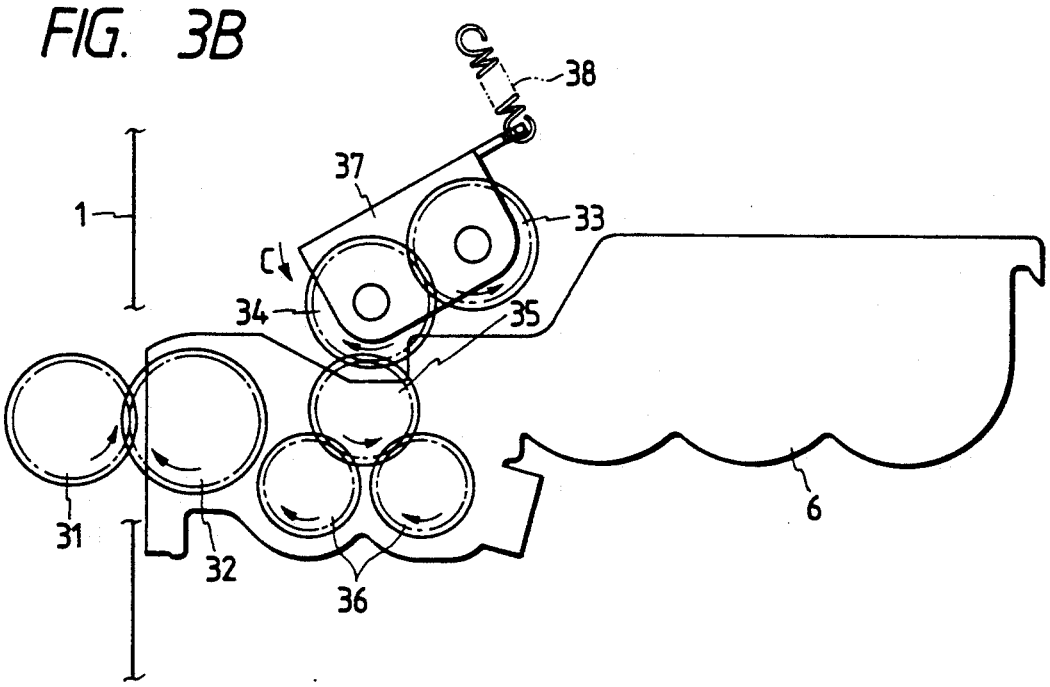
Figure 4:
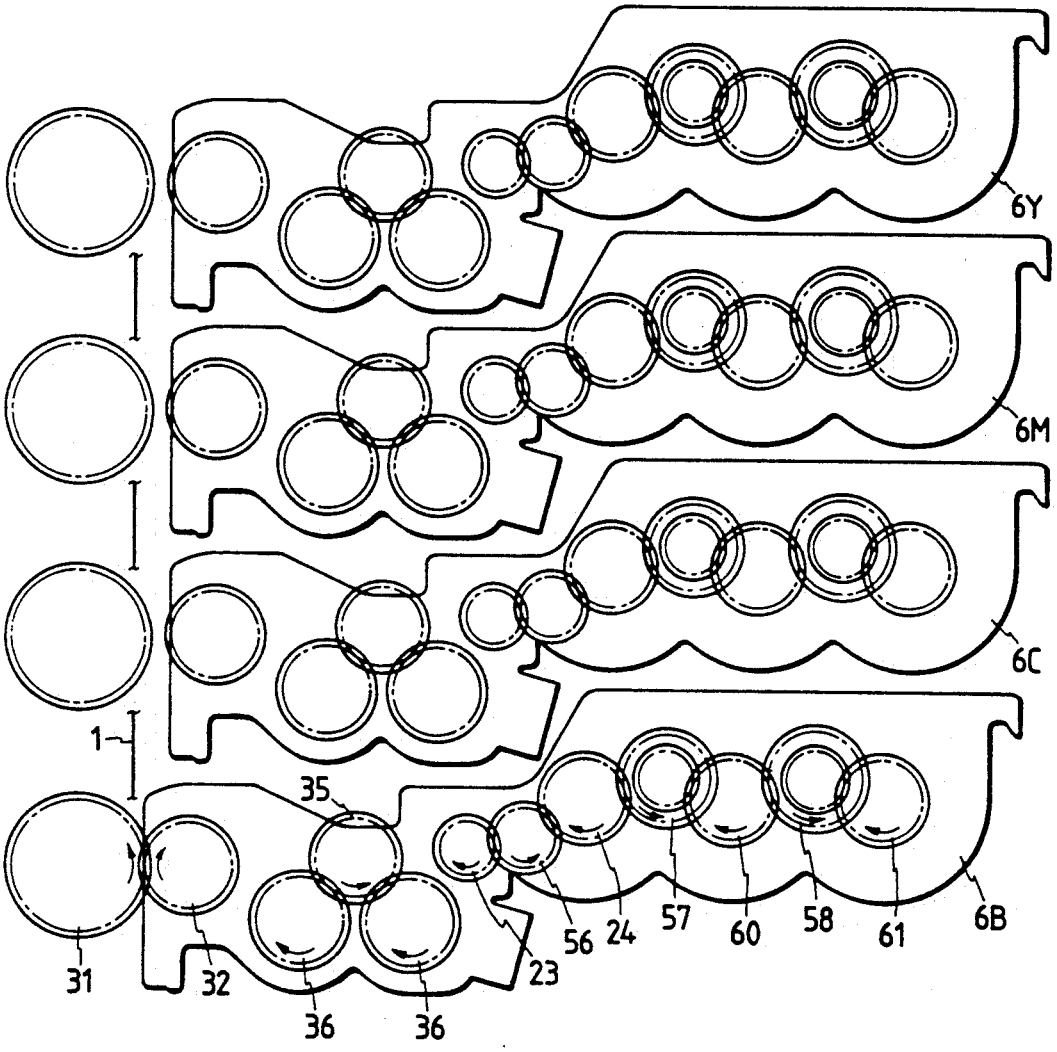
FIG. 4 is a schematic side elevational view showing the manner in which the developing unit assembly operates in the electrophotographic system shown in FIG. 1.

As shown in FIGS. 3A, 3B, and 4, main gears 31 for transmitting the drive force from a drive source (not shown) are disposed outside the developing units 6B, 6C, 6M, 6Y, respectively. When a selected developing unit develops an electrostatic latent image on the image carrier 1, the corresponding main gear 31 is held in mesh with and rotates a gear 32 attached coaxially to one end of the shaft of the developing roller 28. As shown in FIGS. 3A and 3B, a drive gear 33 transmits the drive force from a drive source (not shown) through a driven gear 34 to an idler gear 35 and gears 36 in each of the developing units 6B, 6C, 6M, 6Y, the gears 36 being coupled to the stirring rollers 27. Therefore, the stirring rollers 27 are rotated about their own axes by the drive gear 33. The gear 32 and the gears 36 are held out of mesh with each other in each of the developing units 6B, 6C, 6M, 6Y. The driven gear 34 is rotatably supported by a support 37 that is angularly movably supported on the electrophotographic system housing by the shaft of the drive gear 33. An end of the support 37 remote from the driven gear 34 is normally urged by a tension spring 38 in a direction to move the driven gear 34 in the direction indicated by the arrow C into mesh with the idler roller 35.

As shown in FIGS. 4 and 5, each of the toner hoppers 15B, 15C, 15M, 15Y supports a first transmission gear 56 for transmitting the drive force from a gear 23 mounted on an end of the toner discharge roller 19 to a gear 24 mounted on an end of the first toner feeder 21, a second transmission gear 57 for transmitting the drive force from the gear 24 to a gear 60 mounted on an end of the second toner feeder 22, and a third transmission gear 58 for transmitting the drive power from the gear 60 to a gear 61 mounted on an end of the third toner feeder 59. The gears 23, 56, 24, 57, 60, 58, 61 are of such a gear ratio that the rotational speed V1 of the toner discharge roller 19, the rotational speed V2 of the first toner feeder 21, the rotational speed V3 of the second toner feeder 22, and the rotational speed V4 of the third toner feeder 59 meet the relationship: $V1>V2>V3>V4$.

The electrophotographic system of the above structure operates as follows:

A high voltage is applied to the charging wire 10 in the charger 4 by the high-voltage source, the charging wire 10 produces a corona discharge to uniformly charge the surface of the image carrier 1 to a potential ranging from −700 V to −800 V. Then, the image carrier 1 is rotated in the direction indicated by the arrow A (FIG. 1). The exposure optical system 5 applies a light beam 13 such as a laser beam representative of one of color images, e.g., a black (B) image, to the uniformly charged surface of the image carrier 1, thereby forming an electrostatic latent image corresponding to the black (B) image on the image carrier 1. The developing unit 6B that contains the black toner 14B is then pushed in the direction indicated by the arrow B by the displacing cam 39B that is rotated in response to a color selection signal from the host computer, until the developing unit 6B abuts against the image carrier 1. When the developing unit 6B is displaced toward the image carrier 1, the gear 32 is brought into mesh with the main gear 31, as shown in FIG. 3B, and the developing roller 28 starts rotating. The stirring roller 27 and the toner concentration detector 40, which jointly serve as a toner concentration adjusting unit, operate at all times. The other developing units 6C, 6M, 6Y remain spaced from the image carrier 1, and the developing rollers 28 therein are held at rest. However, the stirring rollers 27 in the developing units 6C, 6M, 6Y are rotated by the drive source through the gears 33, 34, 35, 36, and the toner concentration adjusting units in the developing units 6C, 6M, 6Y also operate at all times. The toner 14B and the carrier 16 of the developer 17B in the developing housing 18B are mixed, stirred, and triboelectrically charged, and magnetically attracted to the developing roller 28 by the magnet roller 29, forming a magnetic brush on the developing roller 28. As the developing roller 23 rotates in the direction indicated by the arrow H (FIG. 2), the magnetic brush is fed to an N pole of the magnet roller 29 which faces the image carrier 1. While the magnetic brush of the developer 17B is being in contact with the image carrier 1, a potential difference is applied between the developing roller 28 and the image carrier 1, attracting the toner 14B to the electrostatic latent image corresponding to the black (B) image on the image carrier 1. The electrostatic latent image corresponding to the black (B) image is thus developed into a toner image. As the development process progresses, the toner 14B in the developing housing 18B is consumed because it is attracted to the image carrier I. When the toner concentration detector 40 detects that the mixture ratio of the toner 14B and the carrier 16 in the developing housing 18B drops below a predetermined value, the toner concentration detector 40 produces a detected signal to rotate the toner discharge roller 19 in the toner hopper 15B. Upon rotation of the toner discharge roller 19, the toner 14B attached to the surface of the toner discharge roller 19 is scraped off by an edge of the toner discharge port 20, and supplied through the toner discharge port 20 onto the stirring roller 27 in the developing housing 18B. The toner 14B is continuously supplied until the mixture ratio of the toner 14B and the carrier 16 in the developing housing 18B restores a desired value. In this manner, the mixture ratio in the developing housing 18B is maintained at a constant level. In synchronism with the rotation of the toner discharge roller 19, the first, second, and third toner feeders 21, 22, 59 in the toner hopper 15B rotate along the overlapping circular paths indicated by the dot and dash lines in FIG. 2, for thereby stirring and feeding the toner 14B to the toner discharge roller 19. When the toner 14B is thus fed to the toner discharge roller 19, the rotational speeds of the first, second, and third toner feeders 21, 22, 59 are progressively lower than the rotational speed of the toner discharge roller 19, as described above. Therefore, the amount of toner supplied to a toner feeder is smaller than the amount of toner fed thereby. Consequently, excess toner is prevented from being fed to the toner discharge roller 19B, and hence from being aggregated in the toner hopper 15B and on the toner discharge roller 19B. Since the rotational speeds of the first, second, and third toner feeders 21, 22, 59 are relatively low as compared with the rotational speed of the toner discharge roller 19, the amount of fine powder toner that is produced by impingement of the first, second, and third toner feeders 21, 22, 59 upon the toner 14B is reduced. In addition, the drive force required to rotate the first, second, and third toner feeders 21, 22, 59 is also reduced.

When the first toner feeder 21, which is positioned adjacent to the toner discharge roller 19, is angularly moved from a position i to a position j, for example, in the direction indicated by the arrow D (FIG. 2) in order to supply the toner 14B to the toner discharge roller 19, the toner feeder member **21*b* is engaged by a curved portion 6*a* of the toner hopper 15B, and starts being turned about the shafts 21*e*. As the toner feeder 21 is further angularly moved to a position k, the toner feeder member 21*b* is disengaged from the curved portion 6*a*, and springs back to its normal angular position under the resiliency of the return springs 21*c*. The toner feeder 21 repeats the above rotating cycle to continuously supply the toner 14B to the toner discharge roller 19**.

After the electrostatic latent image corresponding to the black (B) image has been developed into the toner image, the developing unit 6B is displaced away from the image carrier 1 by the displacing cam 39B as it turns 180° and the spring (not shown). The magnetic brush on the developing roller 28 no longer contacts the image carrier 1. At the same time, the gear 32 is displaced out of mesh with the main gear 31, and hence the developing roller 28 is stopped. The driven gear 34 however remains held in mesh with the idler roller 35 so that the stirring rollers 27 keep rotating through the gears 33, 34, 35, 36 to continuously triboelectrically charging the toner 14B in the developing housing 17B. At the same time, the toner concentration detector 40 continuously operates to keep adjusting the concentration of the toner 14B in the developing housing 17B. The toner image developed on the image carrier 1 by the developing unit 6B is subsequently transferred onto the intermediate image transfer belt 41 when a voltage is applied to the intermediate image transfer rollers 44.

If the color of cyan (C) is selected next, then the displacing cam 39C is turned to displace the developing unit 6C toward the image carrier 1 against the spring until the developing unit 6C abuts against the image carrier 1 for starting to develop an electrostatic latent image on the image carrier 1 into a cyan (C) toner image.

The above process which has been described with respect to the development of the black (B) toner image is successively repeated until other three color toner images, i.e., cyan (C), magenta(M), and yellow (Y) toner images, are developed on the image carrier 1, and then transferred onto the intermediate image transfer belt 41 in a superimposed fashion. Therefore, a composite toner image composed of the black (B), cyan (C), magenta(M), and yellow (Y) toner images, is formed on the intermediate image transfer belt 41. The composite toner image is thereafter transferred onto the copy sheet 47 that has been fed from the copy sheet cassette 46 along the sheet path 49, by the image transfer roller 52 to which a voltage is applied and which is pressed against the feed roller 43. The composite toner image transferred onto the copy sheet 47 is then fixed to the copy sheet 47 by the heat of the heater roller 54 and under the pressure of the presser roller 55 in the image fixing unit 53. The fixed composite toner image is now available as a final color image produced by the electrophotographic system.

Figure 6A:
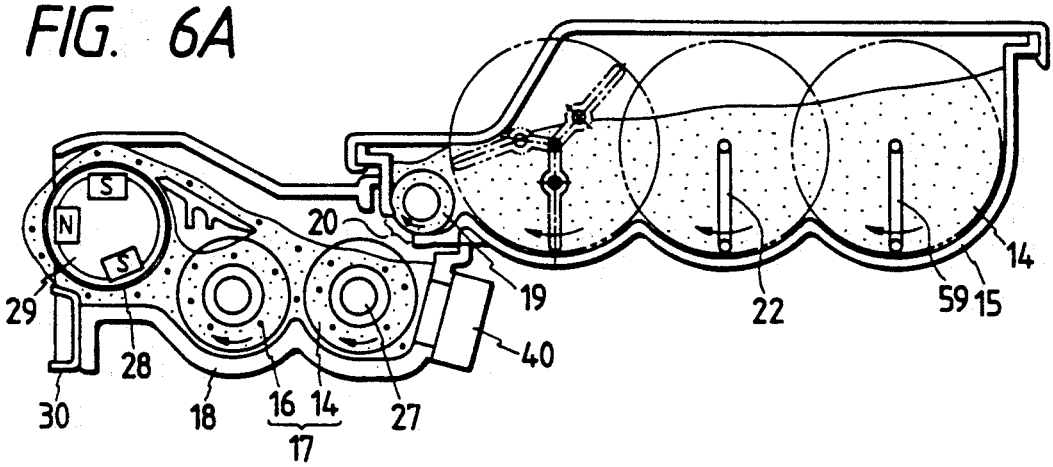
FIGS. 6A through 6F are enlarged side elevational views showing how toner feeders operate in each developing unit in the electrophotographic system shown in FIG. 1.
Figure 6B:
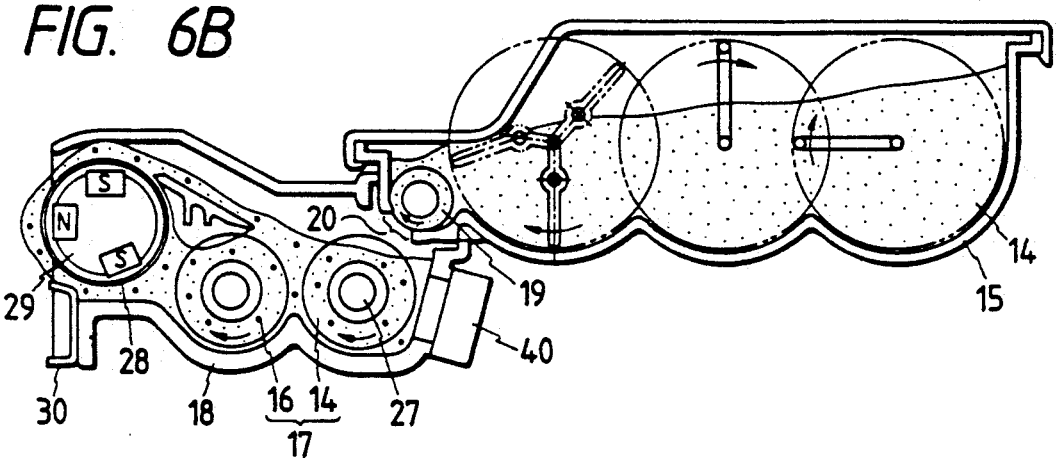
Figure 6C:
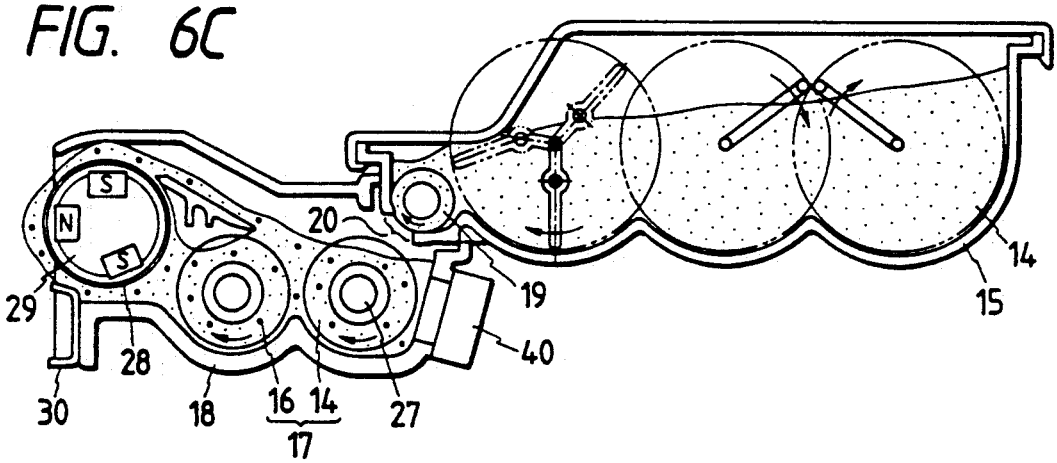
Figure 6D:
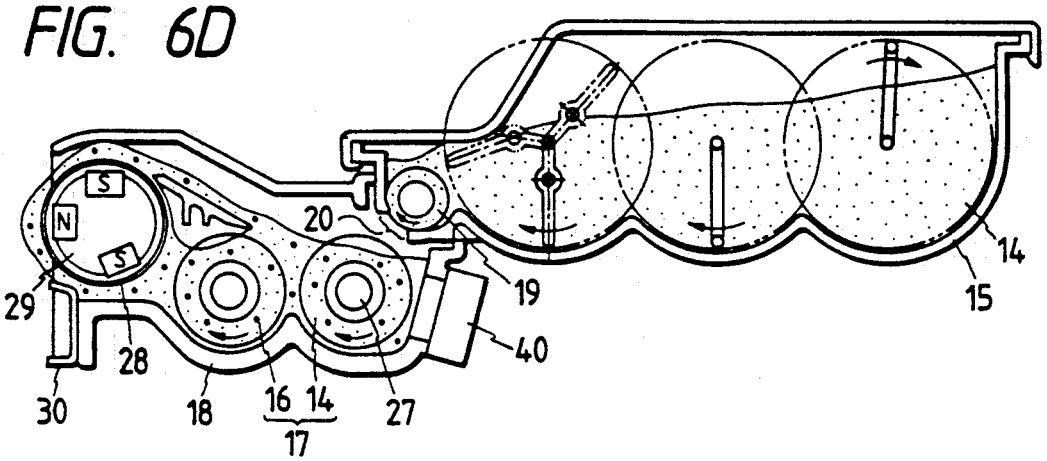
Figure 6E:
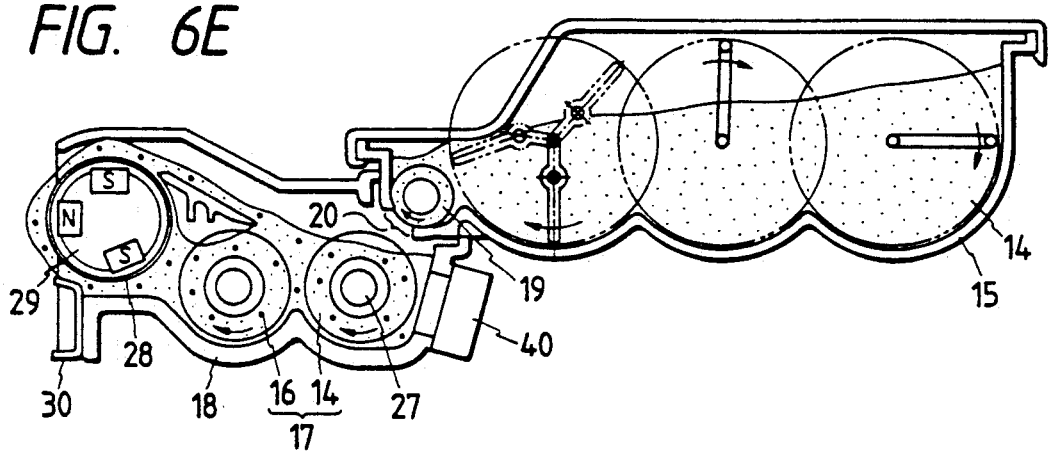
Figure 6F:
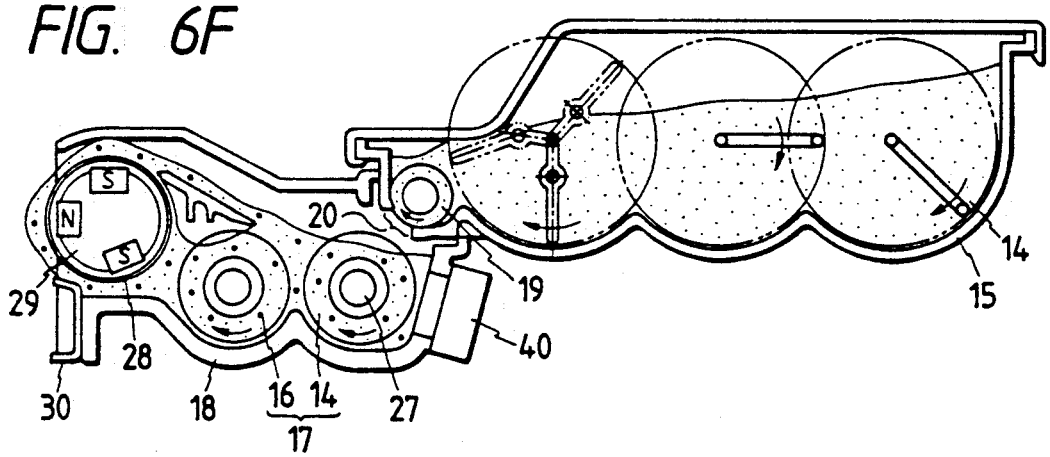

In the above embodiment, the gear ratio of the gears 23, 56, 24, 57, 60, 58, 61 is selected such that the rotational speed V1 of the toner discharge roller 19, the rotational speed V2 of the first toner feeder 21, the rotational speed V3 of the second toner feeder 22, and the rotational speed V4 of the third toner feeder 59 meet the relationship: $V1>V2>V3>V4$. Specifically, the rotational speeds V1, V2, V3, V4 are selected to be $V1:V2:V3:V4=1:\frac{1}{2}:\frac{1}{2}^2:\frac{1}{2}^3$. With such a speed setting, the second and third toner feeders 22, 59 rotate from the position shown in FIG. 6A through the position shown in FIG. 6B to the position shown in FIG. 6C in which the second and third toner feeders 22, 59 pass each other, and then to the position shown in FIG. 6D in which the second toner feeder 22 has made one revolution and the third toner feeder 59 has made $\frac{1}{2}$ revolution. As the second and third toner feeders 22, 59 further rotate through the positions shown in FIGS. 6E and 6F back to the position shown in FIG. 6A, the second toner feeder 22 makes one revolution again and the third toner feeder 59 makes $\frac{1}{2}$ revolution again. The second and third toner feeders 22, 59 subsequently repeat the above cycle. Therefore, even though the second and third toner feeders 22, 59 rotate along overlapping paths, they are prevented from physically interfering with each other by the above speed setting.

While the second toner feeder 22 is making one revolution, the third toner feeder 59 is synchronized therewith so that it makes $\frac{1}{2}$ revolution, as described above. However, while the second toner feeder 22 is making one revolution, the third toner feeder 59 may be synchronized therewith so that it makes $\frac{1}{2}^n$ rotation (n is a positive integer) to prevent itself from physically interfering with the second toner feeder 22 as they rotate along overlapping paths.

Figure 7:
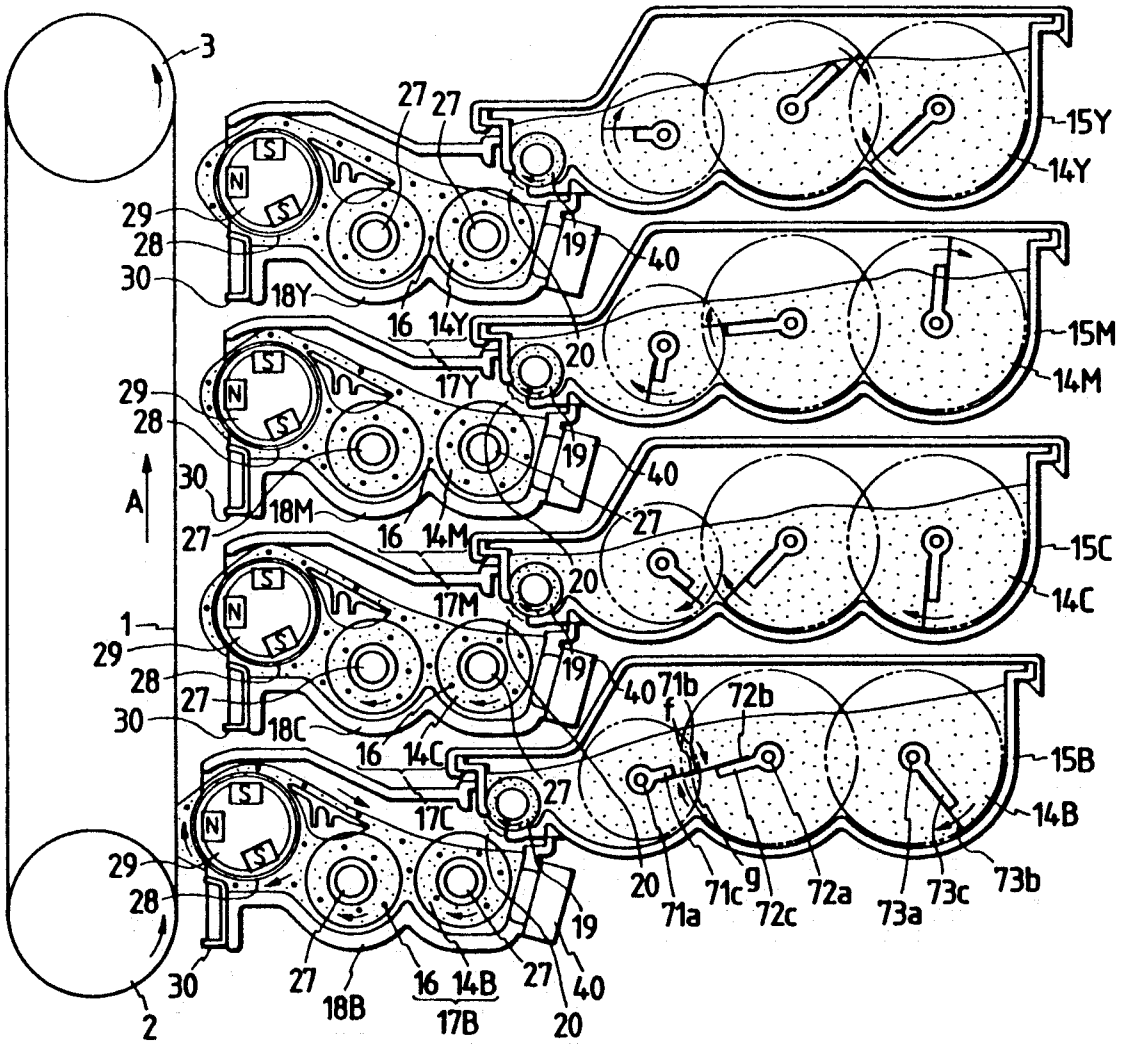
FIG. 7 is an enlarged side elevational view of a modified developing unit assembly in which toner feeders have flexible toner feeder members.
Figure 8:
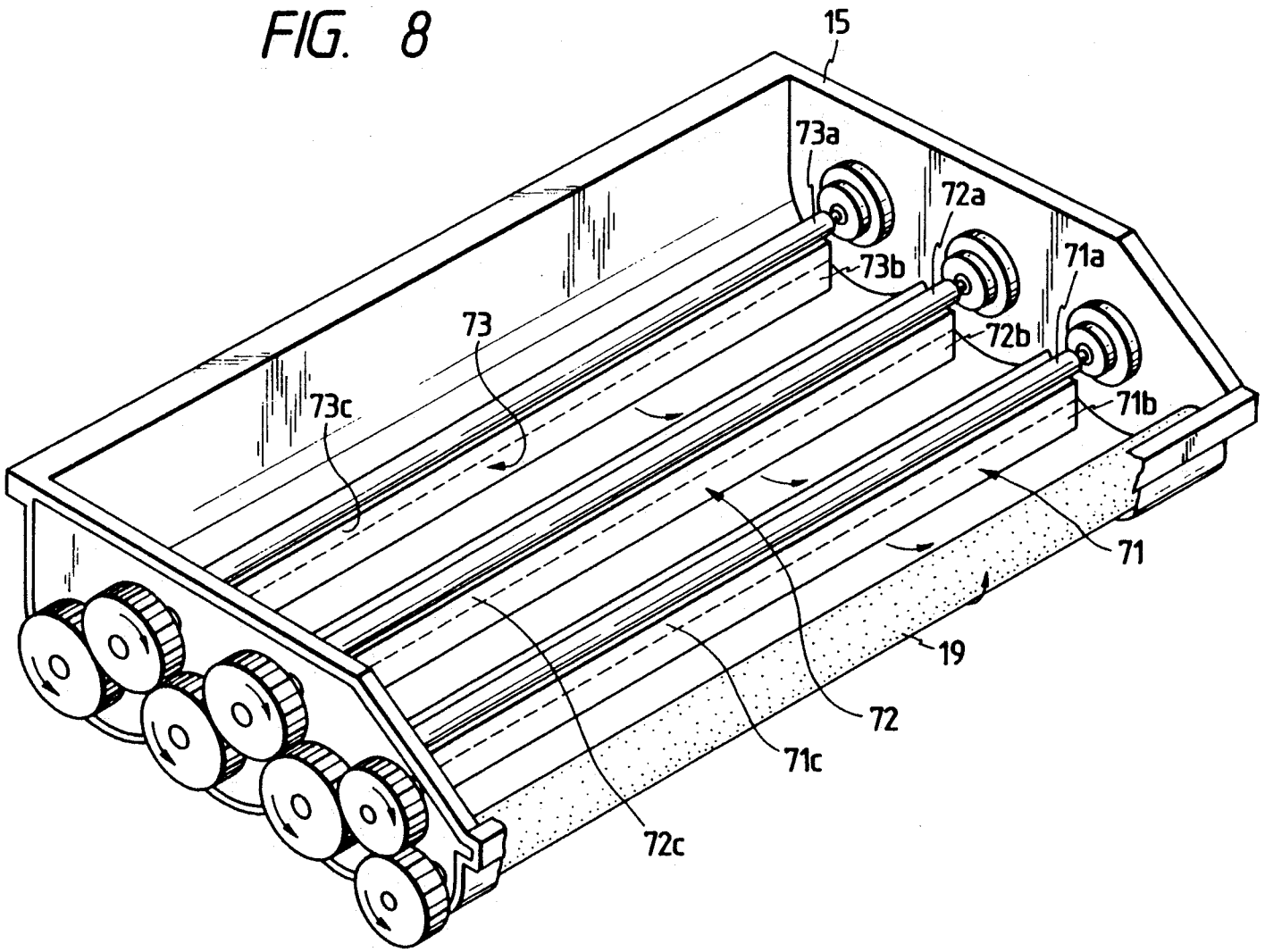
FIG. 8 is a perspective view of a developing unit of the developing unit assembly shown in FIG. 7.

A modified developing unit assembly for use in the electrophotographic system is shown in FIGS. 7 and 8.

As shown in FIGS. 7 and 8, the developing units have, in their toner hoppers 15B, 15C, 15M, 15Y, respective first toner feeders 71 disposed adjacent to the toner discharge rollers 19. Each of the first toner feeders 71 comprises a flat plate 71*c* rotatably supported on opposite side walls of the toner hopper by a shaft 71*a*, and a toner feeder member or flap 71*b* in the form of a flexible sheet of synthetic resin or the like fixed to the flat plate 71*c* and spaced a small distance from the bottom of the toner hopper. Each developing unit also includes a second toner feeder 72 disposed adjacent to the first toner feeder 71 and comprising a flat plate 72*c* rotatably supported on opposite side walls of the toner hopper by a shaft 72*a*, and a toner feeder member or flap 72*b* in the form of a flexible sheet of synthetic resin or the like fixed to the flat plate 72*c* and spaced a small distance from the bottom of the toner hopper, and a third toner feeder 73 disposed adjacent to the second toner feeder 72 and comprising a flat plate 73*c* rotatably supported on opposite side walls of the toner hopper by a shaft 73*a*, and a toner feeder member or flap 73*b* in the form of a flexible sheet of synthetic resin or the like fixed to the flat plate 73*c* and spaced a small distance from the bottom of the toner hopper. The flat plates 71*c*, 72*c*, 73*c* are rotatable along circular paths that do not overlap each other.

Operation of the first, second, and third toner feeders 71, 72, 73 in the toner hopper 15B will be described below. As shown in FIG. 7, in synchronism with the rotation of the toner discharge roller 19, the first, second, and third toner feeders 71, 72, 73 rotate along the overlapping circular paths indicated by the dot-and-dash lines, for thereby stirring and feeding the toner 14B to the toner discharge roller 19. Even when the first and second toner feeders 71, 72 meet each other in positions f, g along their overlapping paths as shown in FIG. 7, the feeder members 71*b*, 72*b* thereof are caused to flex and pass each other because they are flexible. The feeder members 72*b*, 73*b* of the second and third toner feeders 72, 73 also flex and pass each other when they meet along their over-lapping paths. Accordingly, the first, second, and third toner feeders 71, 72, 73 are prevented from being stopped by physical interference with each other.

Figure 9:
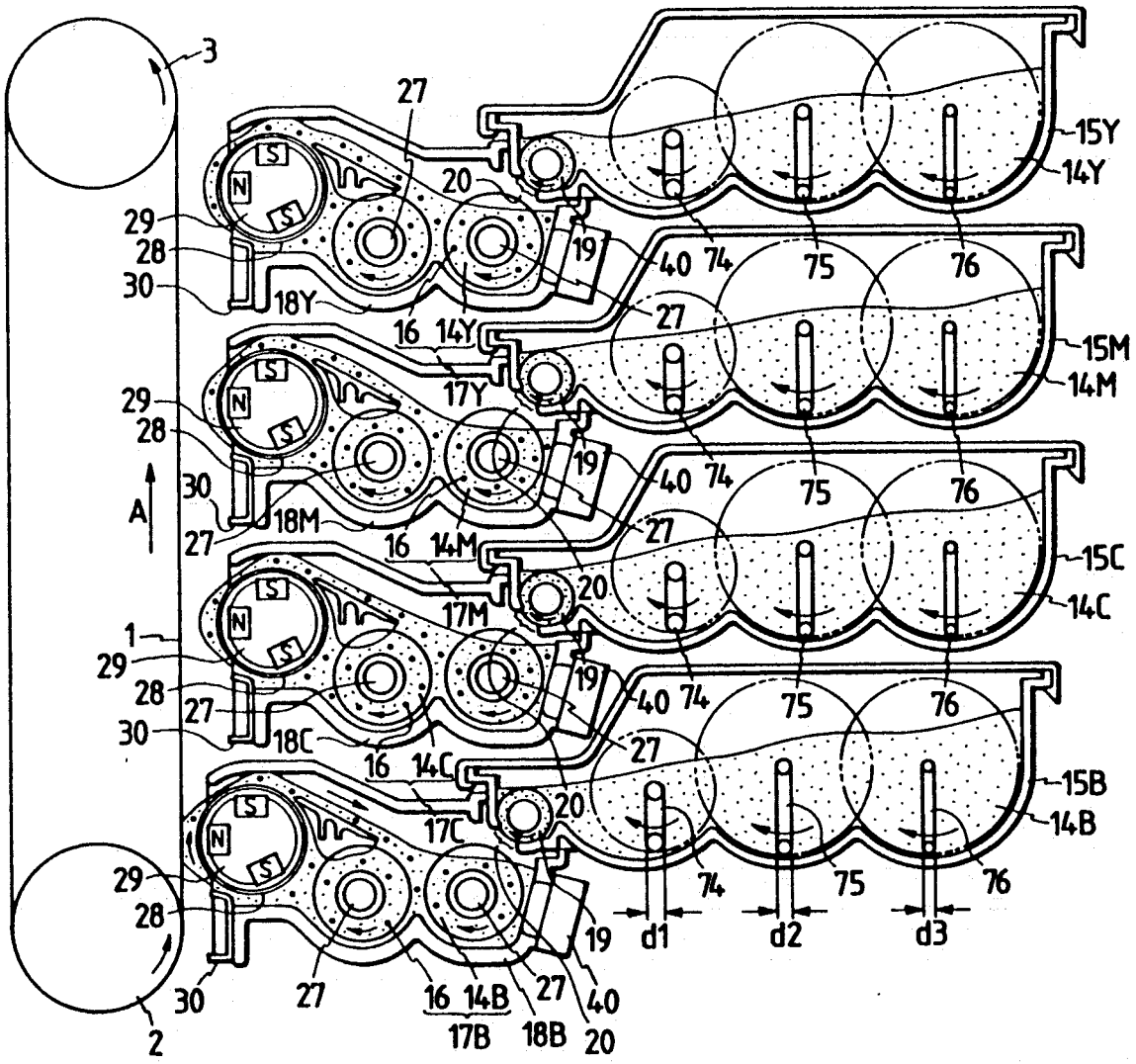
FIG. 9 is an enlarged side elevational view of a developing unit assembly in an electrophotographic system according to a second embodiment of the present invention.
Figure 10:
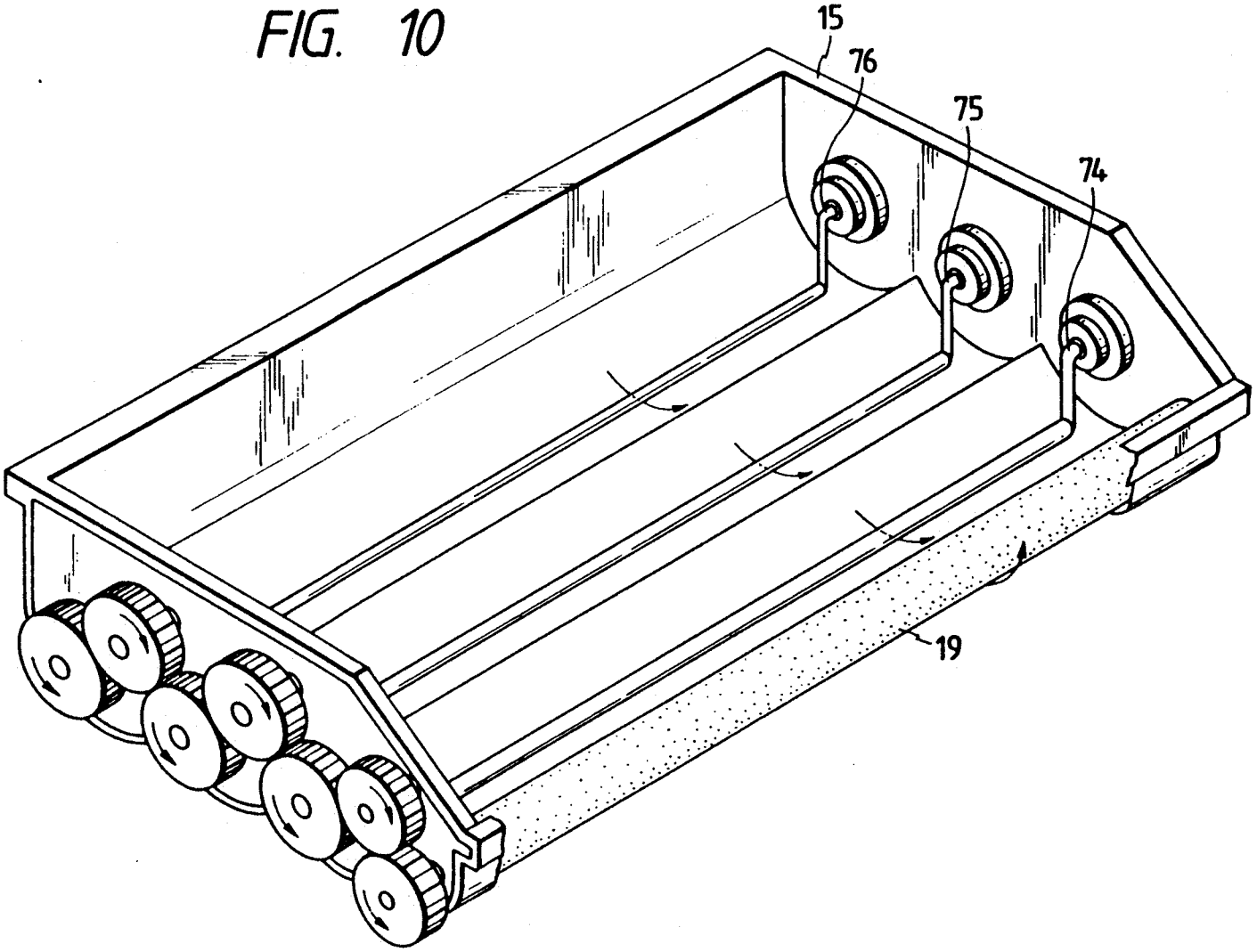
FIG. 10 is a perspective view of a developing unit of the developing unit assembly shown in FIG. 9.

FIGS. 9 and 10 show an electrophotographic system according to a second embodiment of the present invention.

As shown in FIGS. 9 and 10, the developing units have, in their toner hoppers 15B, 15C, 15M, 15Y, respective first toner feeders 74 disposed adjacent to the toner discharge rollers 19. Each of the first toner feeders 74 comprises a shaft-like wire bent into a rectangular shape and is rotatably supported at its opposite ends on opposite side walls of the toner hopper and spaced a small distance from the bottom of the toner hopper. Each developing unit also includes a second toner feeder 75 disposed adjacent to the first toner feeder 76 and comprising a shaft-like wire bent into a rectangular shape and rotatably supported at its opposite ends on opposite side walls of the toner hopper and spaced a small distance from the bottom of the toner hopper, and a third toner feeder 76 disposed adjacent to the second toner feeder 75 and comprising a shaft-like wire bent into a rectangular shape and rotatably supported at its opposite ends on opposite side walls of the toner hopper and spaced a small distance from the bottom of the toner hopper. The first, second, and third toner feeders 74, 75, 76 have respective wire diameters d1, d2, d3 that meet the relationship: $d1>d2>d3$.

Operation of the electrophotographic system according to the second embodiment will be described below.

As shown in FIG. 9, in synchronism with the rotation of the toner discharge roller 19, the first, second, and third toner feeders 74, 75, 76 rotate along the over-lapping circular paths indicated by the dot-and-dash lines, for thereby stirring and feeding the toner 14B to the toner discharge roller 19. The wire diameters of the second and third toner feeders 75, 76 are progressively smaller than the wire diameter of the first toner feeder 74, as described above. Since the amount of toner fed from the second and third toner feeders 75, 76 to the first toner feeder 74 is relatively small because of their relatively small wire diameters, excess toner is prevented from being supplied to the toner discharge roller 19 and hence from being aggregated on the toner discharger roller 19.

Figure 11:
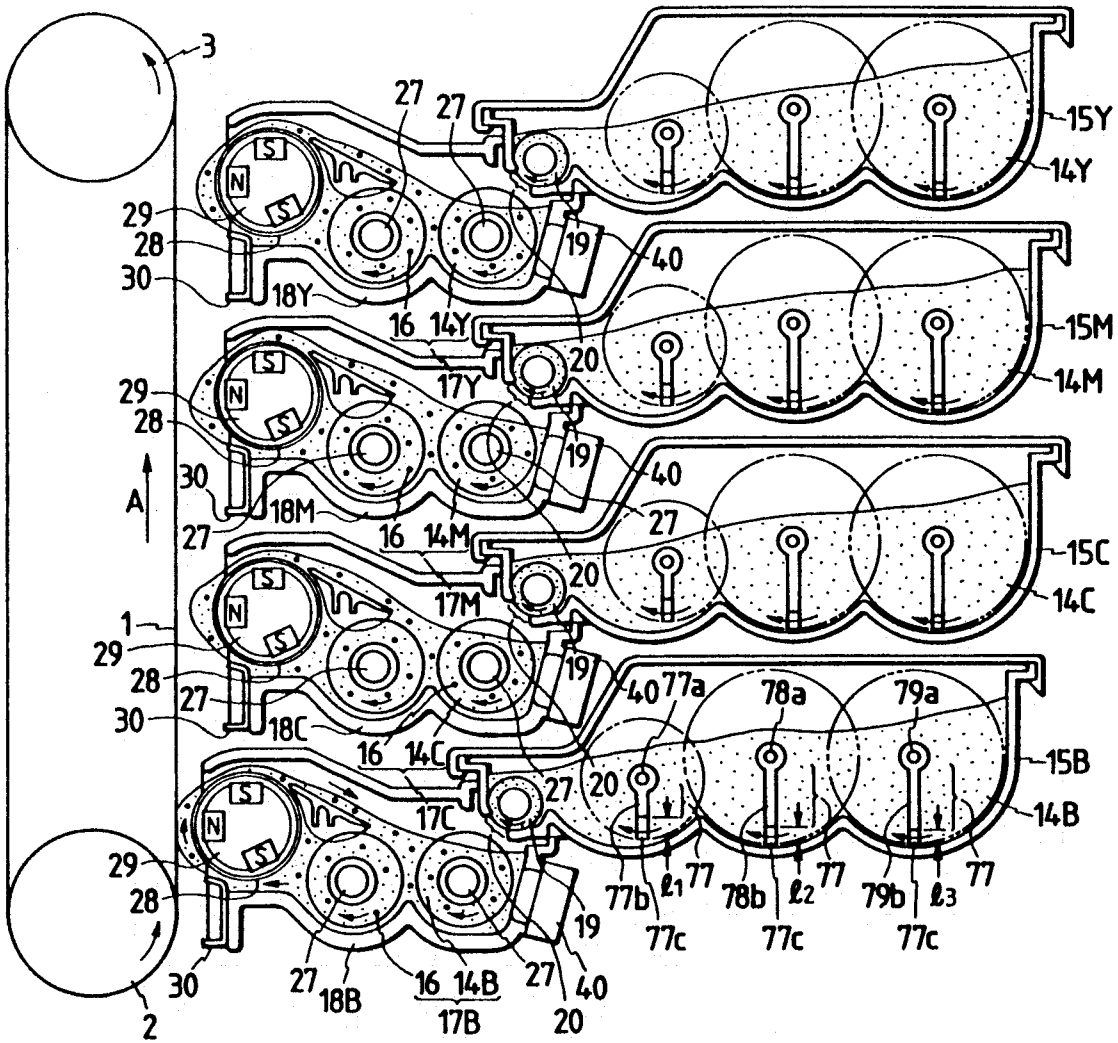
FIG. 11 is an enlarged side elevational view of a modified developing unit assembly which has plate-like toner feeders.
Figure 12:
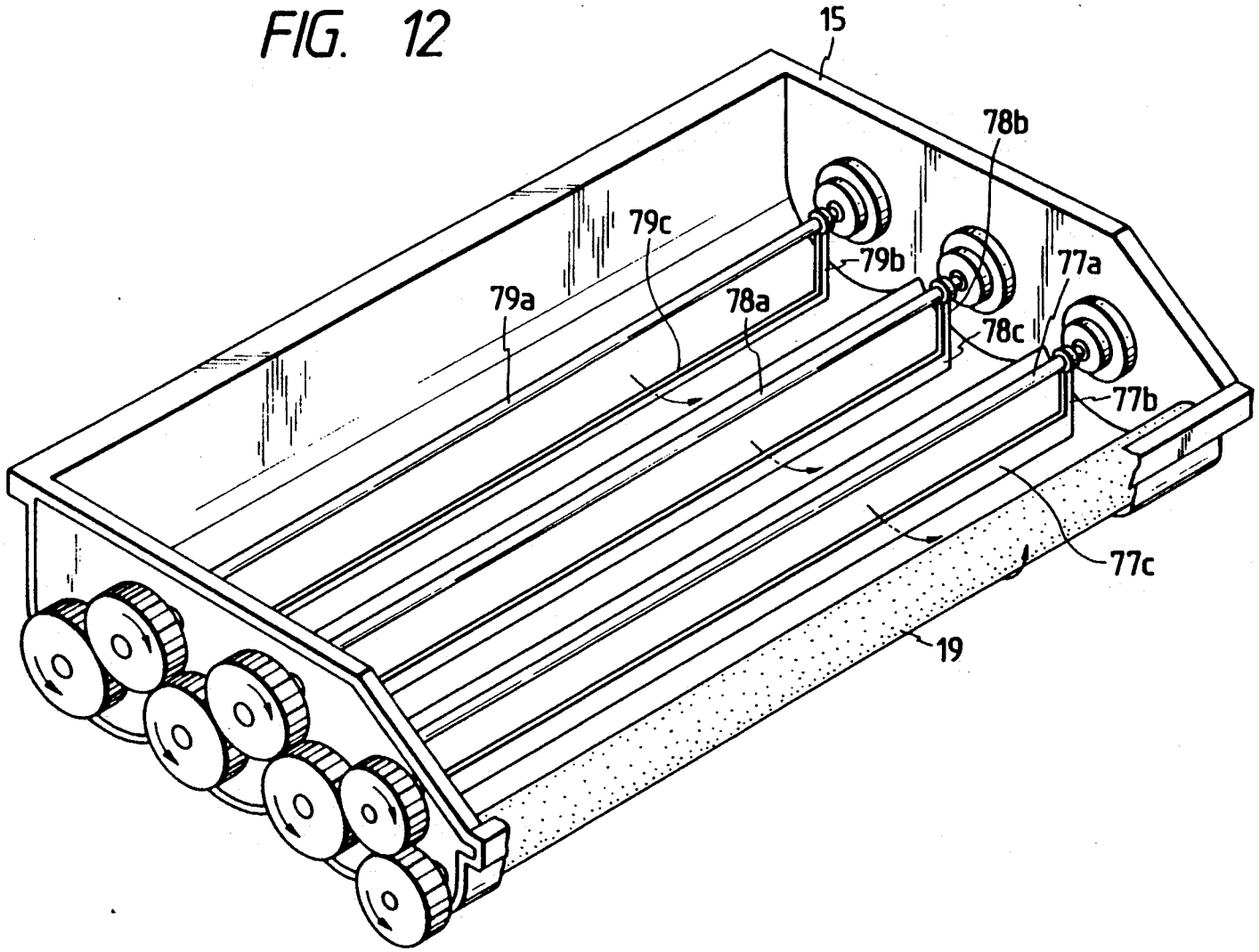
FIG. 12 is a perspective view of a developing unit of the developing unit assembly shown in FIG. 11.

FIGS. 11 and 12 show a modified developing unit assembly according to the present invention.

As shown in FIGS. 11 and 12, the developing units have, in their toner hoppers 15B, 15C, 15M, 15Y, respective first toner feeders 77 disposed adjacent to the toner discharge rollers 19. Each of the first toner feeders 77 comprises a feeder arm 77*b* rotatably supported at its opposite ends on opposite side walls of the toner hopper by a shaft 77*a*, and a feeder plate 77*c* fixedly supported on the feeder arm 77*b* and spaced a small distance from the bottom of the toner hopper. Each developing unit also includes a second toner feeder 78 disposed adjacent to the first toner feeder 77 and comprising a feeder arm 78*b* rotatably supported at its opposite ends on opposite side walls of the toner hopper by a shaft 78*a*, and a feeder plate 78*c* fixedly supported on the feeder arm 78*b* and spaced a small distance from the bottom of the toner hopper, and a third toner feeder 79 disposed adjacent to the second toner feeder 78 and comprising a feeder arm 79*b* rotatably supported at its opposite ends on opposite side walls of the toner hopper by a shaft 79*a*, and a feeder plate 79*c* fixedly supported on the feeder arm 79*b* and spaced a small distance from the bottom of the toner hopper. The feeder plates 77*c*, 78*c*, 79*c* of the first, second, and third toner feeders 77, 78, 79 have respective widths 11, 12, 13 that meet the relationship: 11>12>13.

The developing unit assembly shown in FIGS. 11 and 12 operates as follows:

As shown in FIG. 11, in synchronism with the rotation of the toner discharge roller 19, the first, second, and third toner feeders 77, 78, 79 in the toner hopper 15B rotate along the overlapping circular paths indicated by the dot-and-dash lines, for thereby stirring and feeding the toner 14B to the toner discharge roller 19. The widths of the feeder plates 78*c*, 79*c* of the second and third toner feeders 78, 79 are progressively smaller than the width of the feeder plate 77*c* of the first toner feeder 77, as described above. Since the amount of toner fed from the second and third toner feeders 78, 79 to the first toner feeder 77 is relatively small because of their relatively small plate widths, excess toner is prevented from being supplied to the toner discharge roller 19 and hence from being aggregated on the toner discharger roller 19.

Figure 13:
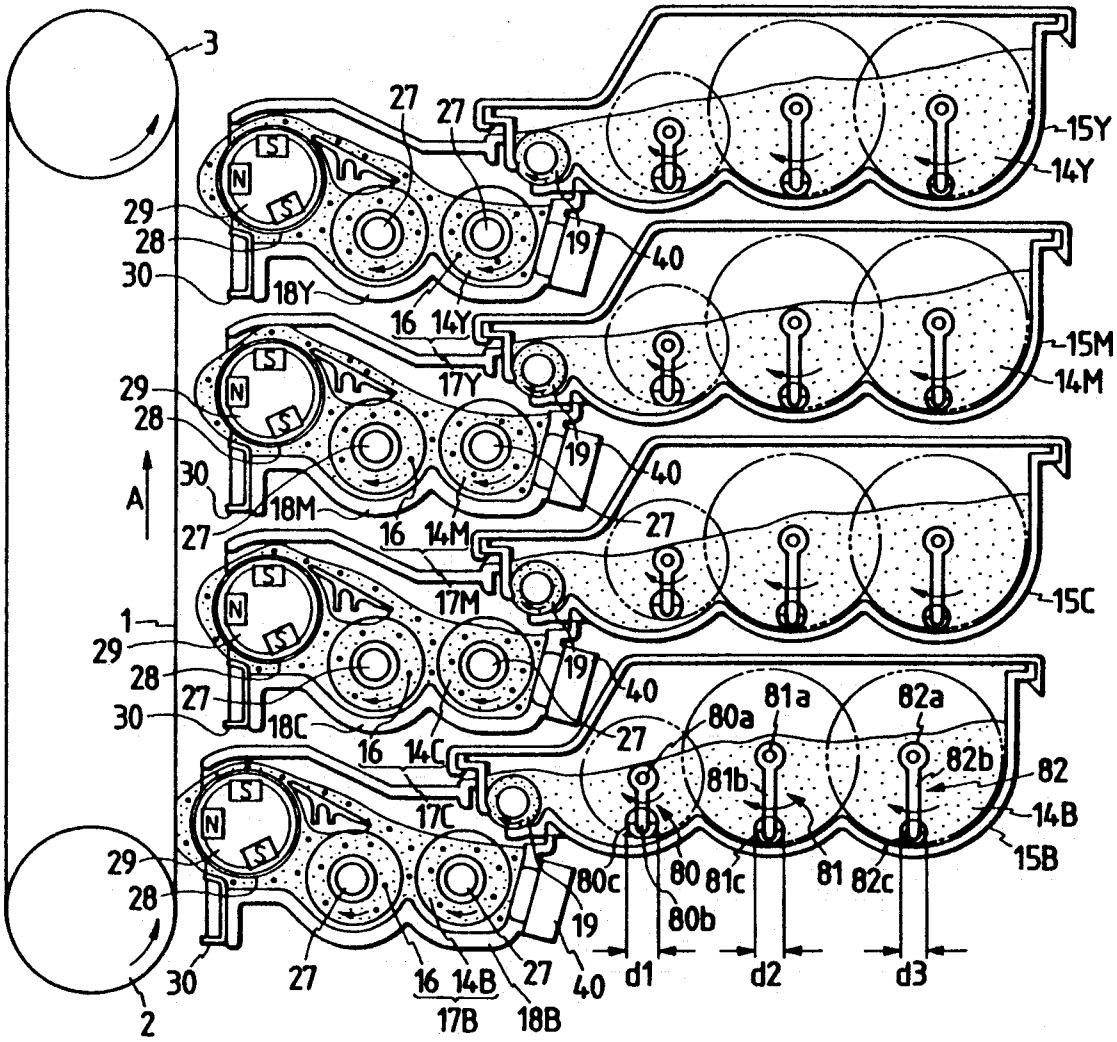
FIG. 13 is an enlarged side elevational view of another modified developing unit assembly which has toner feeders in the form of coil springs.
Figure 14:
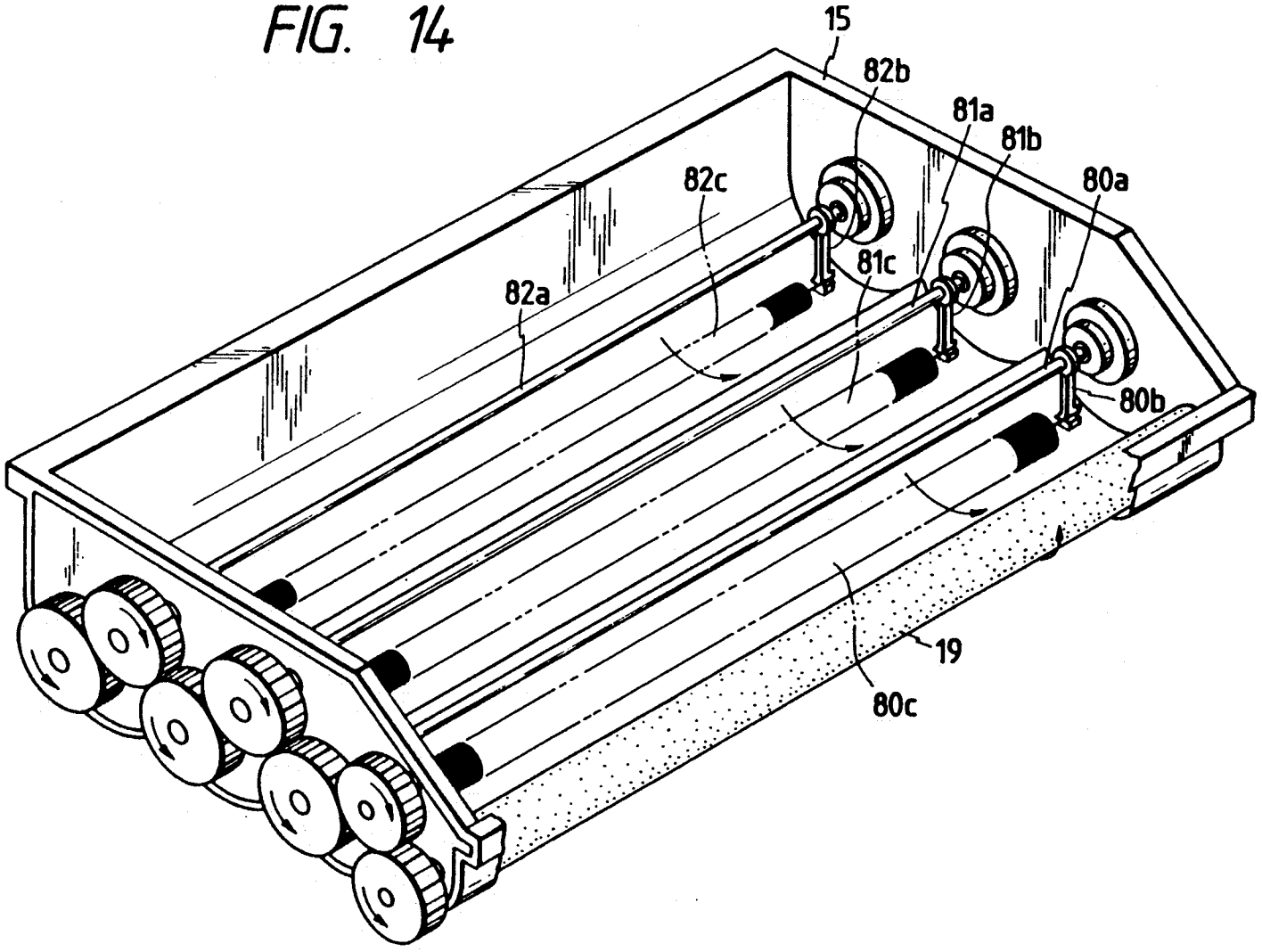
FIG. 14 is a perspective view of a developing unit of the developing unit assembly shown in FIG. 13.
Figure 15:
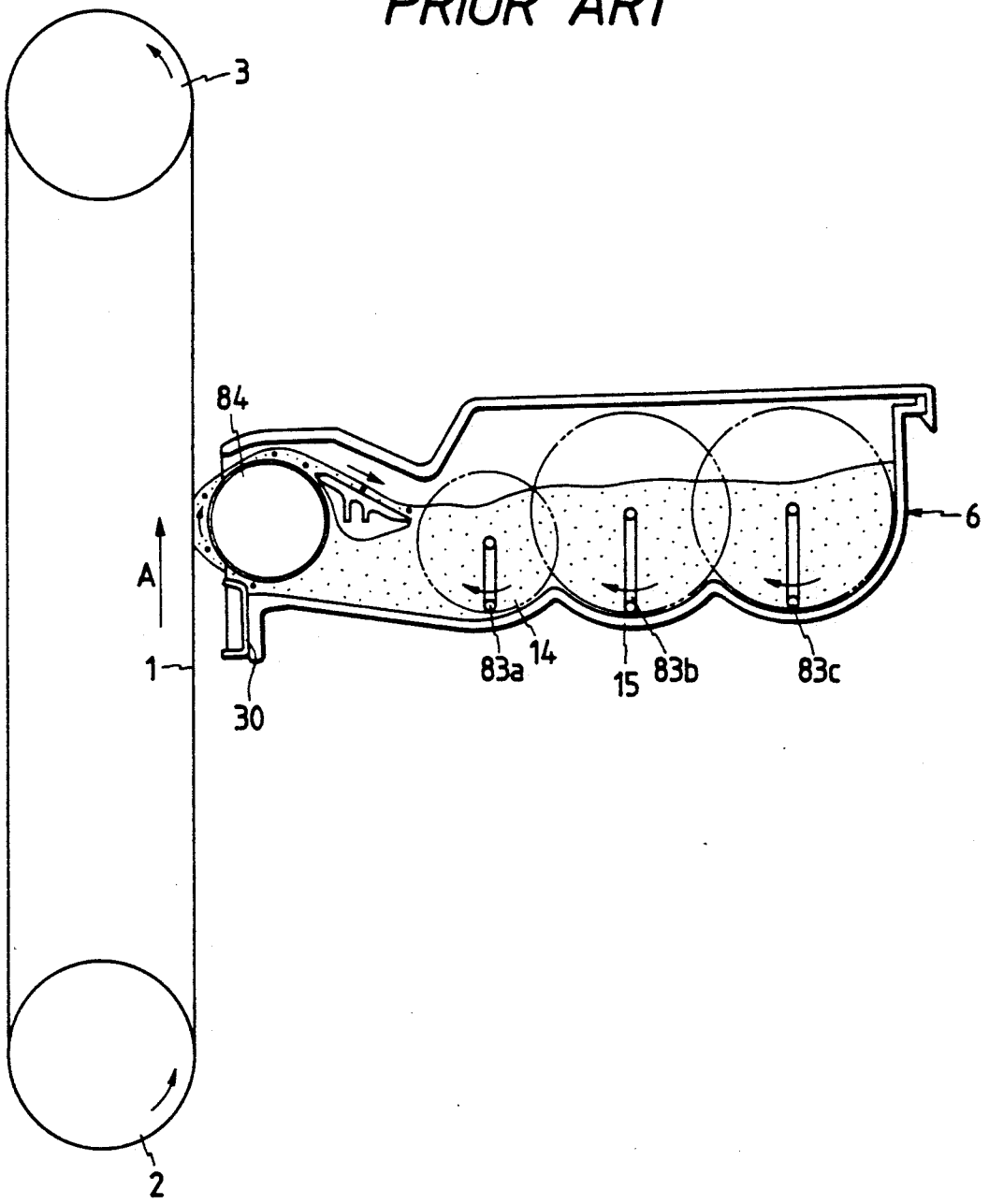
FIG. 15 PRIOR ART
FIG. 15 is a side elevational view of a conventional electrophotographic system.

FIGS. 13 and 14 show another modified developing unit assembly according to the present invention.

As shown in FIGS. 13 and 14, the developing units have, in their toner hoppers 15B, 15C, 15M, 15Y, respective first toner feeders 80 disposed adjacent to the toner discharge rollers 19. Each of the first toner feeders 80 comprises a feeder arm 80*b* rotatably supported at its opposite ends on opposite side walls of the toner hopper by a shaft 80*a*, and a coil spring 80*c* supported on the feeder arm 80*b* and spaced a small distance from the bottom of the toner hopper. Each developing unit also includes a second toner feeder 81 disposed adjacent to the first toner feeder 80 and comprising a feeder arm 81*b* rotatably supported at its opposite ends on opposite side walls of the toner hopper by a shaft 81*a*, and a coil spring 81*c* supported on the feeder arm 81*b* and spaced a small distance the bottom of the toner hopper, and a third toner feeder 82 disposed adjacent to the second toner feeder 81 and comprising a feeder arm 82*b* rotatably supported at its opposite ends on opposite side walls of the toner hopper by a shaft 82*a*, and a coil spring 82*c* supported on the feeder arm 82*b* and spaced a small distance from the bottom of the toner hopper. The coil springs 80*c*, 81*c*, 82*c* of the first, second, and third toner feeders 80, 81, 82 have respective diameters d1, d2, d3 that meet the relationship: d1>d2>d3.

The developing unit assembly in FIGS. 13 and 14 operates as follows:

As shown in FIG. 13, in synchronism with the rotation of the toner discharge roller 19, the first, second, and third toner feeders 80, 81, 82 in the toner hopper 15B rotate at the same speed along the overlapping circular paths indicated by the dot-and-dash lines, for thereby stirring and feeding the toner 14B to the toner discharge roller 19. The diameters of the coil springs 81*c*, 82*c* of the second and third toner feeders 81, 82 are progressively smaller than the diameter of the coil spring 80*c* of the first toner feeder 80, as described above. Since the amount of toner fed from the second and third toner feeders 81, 82 to the first toner feeder 80 is relatively small because of their relatively small plate widths, excess toner is prevented from being supplied to the toner discharge roller 19 and hence from being aggregated on the toner discharger roller 19. Each of the coil springs 80*c*, 81*c*, 82*c* has a wire diameter of about 0.1 mm. Therefore, the coil springs 80*c*, 81*c*, 82*c* do not press the toner 14B to the bottom of the toner hopper 15B, may be rotated with a relatively small torque, and consume a relatively small amount of electric power. Since the coil springs 80*c*, 81*c*, 82*c* have different natural frequencies, they stir the toner differently, so that the toner can be stirred uniformly as a whole in the toner hopper.

Although certain preferred embodiments of the present invention have been shown and described in detail, it should be understood that various changes and modifications may be made therein without departing from the scope of the appended claims.

We claim as our invention:

1. An electrophotographic system comprising:

an image carrier for receiving an electrostatic latent image represented by image information;

developing means for developing the electrostatic latent image into a toner image with toner;

a toner hopper for storing the toner; and a plurality of toner feeders disposed in said toner hopper, for supplying the toner from said toner hopper to said developing means, said toner feeders being successively arranged with respect to said developing means such that those toner feeders which are disposed more remotely from said developing means feed progressively smaller amounts of toner, said toner feeders being rotatable about their own axes for supplying the toner from said toner hopper to said developing means, said toner feeders each comprising feeder arms rotatably supported on opposite side walls of said toner hopper and a toner feeder member supported on said feeder arms, the toner feeder members of said toner feeders which are disposed more remotely from said developing means having progressively smaller areas of contact with the toner.

2. An electrophotographic system comprising:

an image carrier for receiving an electrostatic latent image represented by image information;

developing means for developing the electrostatic latent image into a toner image with toner;

a toner hopper for storing the toner; and a plurality of toner feeders disposed in said toner hopper, for supplying the toner from said toner hopper to said developing means, said toner feeders being successively arranged with respect to said developing means such that those toner feeders which are disposed more remotely from said developing means feed progressively smaller amounts of toner, said toner;

said toner feeders being rotatable about their own axes for supplying the toner from said toner hopper to said developing means, said toner feeders which are disposed more remotely from said developing means rotating at progressively lower speeds;

wherein adjacent ones of said toner feeders are rotatable along overlapping paths, and wherein one of the adjacent toner feeders which is disposed more remotely from said developing means is rotatable at a speed which is $\frac{1}{2}^n$ (n is a positive integer) of the speed of rotation of the other of the adjacent toner feeders that is closer to said developing means.

3. An electrophotographic system according to claim 1, wherein said toner feeder members comprising respective shaft-like wires rotatably supported on said opposite side walls of said toner hopper, and the shaft-like wires of said toner feeder members which are disposed more remotely from said developing means have progressively smaller diameters and hence progressively smaller areas of contact with the toner.

4. An electrophotographic system according to claim 1, wherein said toner feeder members comprise respective plates supported on said feeder arms, respectively, and wherein the plates of said toner feeders which are disposed more remotely from said developing means have progressively smaller widths and hence progressively smaller areas of contact with the toner.

5. An electrophotographic system comprising:

an image carrier for receiving an electrostatic latent image represented by image information;

developing means for developing the electrostatic latent image into a toner image with toner;

a toner hopper for storing the toner; and a plurality of toner feeders disposed in said toner hopper, for supplying the toner from said toner hopper to said developing means, said toner feeders being successively arranged with respect to said developing means such that those toner feeders which are disposed more remotely from said developing means feed progressively smaller amounts of toner;

said toner feeders being rotatable about their own axes for supplying the toner from said toner hopper to said developing means, said toner feeders which are disposed more remotely from said developing means having progressively smaller areas of contact with the toner;

wherein said toner feeders comprise respective feeder arms rotatably supported on opposite side walls of said toner hopper, and respective coil springs supported on said feeder arms, respectively, and wherein the coil springs of said toner feeders which are disposed more remotely from said developing means have progressively smaller diameters and hence progressively smaller areas of contact with the toner.

* * * * *